US005640901A

United States Patent [19]

Kinoshita

[11] Patent Number: 5,640,901

[45] Date of Patent: Jun. 24, 1997

[54] NIP ROLLER INSTALLATION

[75] Inventor: Togo Kinoshita, Wakayama, Japan

[73] Assignee: Noritsu Koki Co., Ltd., Japan

[21] Appl. No.: 599,131

[22] Filed: Feb. 9, 1996

[30] Foreign Application Priority Data

Feb. 16, 1995 [JP] Japan ..... 7-028178

[51] Int. Cl.[6] ..... B30B 3/04

[52] U.S. Cl. ..... 100/169; 100/171; 100/172; 100/176

[58] Field of Search ..... 100/158 R, 164, 100/168, 169, 171, 172, 176

[56] References Cited

U.S. PATENT DOCUMENTS

| | | | |
|---|---|---|---|
| 433,416 | 7/1890 | Marble | 100/172 |
| 476,004 | 5/1892 | Cousen | 100/171 |
| 3,246,822 | 4/1966 | Skeen | 100/172 |
| 3,943,031 | 3/1976 | Krueger et al. | 100/164 |
| 4,145,965 | 3/1979 | Kikuchi et al. | 100/176 |
| 5,034,781 | 7/1991 | Watanabe | 100/164 |

*Primary Examiner*—Stephen F. Gerrity
*Attorney, Agent, or Firm*—Wenderoth, Lind & Ponack

[57] ABSTRACT

In a nip roller apparatus, a drive roller and an idler roller are arranged for conveying an object. The rollers include shafts having toothed wheels mounted thereon for transmitting rotation of the drive roller to the idler roller. A pressing device is provided for biasing the idler roller against the drive roller. The idler roller is mounted in a bearing support which includes guide slots for permitting sliding movement of the idler roller relative to the drive roller. The guide slots are positioned at an angle relative to a line which extends through the centers of the shafts and includes a point of contact between the toothed drive wheel and the toothed idler wheel.

5 Claims, 3 Drawing Sheets

NIP ROLLER INSTALLATION

BACKGROUND OF THE INVENTION

The present invention relates to an improvement in a nip roller apparatus for conveying objects between a drive roller and an idler roller.

As shown in FIG. 4, a conventional nip roller installation includes a drive roller 4A, an idler roller 4B pressing against the drive roller 4A, and two toothed wheels 4E, 4F mounted on shafts 4C, 4D of the rollers 4A, 4B, respectively, for transmitting rotation of the drive roller 4A to the idler roller 4B.

As best shown in FIG. 5, the shaft 4D of the idler roller 4B is supported in a bearing journal (not shown) by a bearing slide 4G (denoted by the hatching) for permitting sliding movement of the idler roller 4B. Also, the idler roller 4B is resiliently biased by a spring material (not shown) against the drive roller 4A.

The conventional nip roller installation, however, allows the idler roller 4B to press against the center of the rotation of the drive roller 4A (FIG. 5).

Therefore, if the idler roller 4B is overloaded with a strong resistance force during a conveying operation, a stress will occur on the contact surface of the toothed wheel 4F. The contact surface of each toothed wheel is arranged at an angle of pressure α. Accordingly, a counter force P of the stress is produced on the contact surface of the toothed wheel 4E. A partial or component force P1 of the counter force P acts on the idler roller 4B in a direction which opposes the pressing force of the idler roller 4B. This condition may create a difference in the nip pressure between opposite sides of the nip roller apparatus, thus causing zigzag movements of an object being conveyed by the roller apparatus.

In order to eliminate the difference in the nip pressure, a modification has been proposed in which toothed wheels are provided at both sides of the roller apparatus. However, the modification will cause increases in the dimensions and cost of the apparatus. In addition, the force of resistance on the idler roller may be increased thus attenuating the nip pressure.

It is an object of the present invention, in view of the foregoing problems, to provide an improved nip roller apparatus in which the idler roller remains unaffected by any counter forces when a resistance load is applied during a conveying operation.

SUMMARY OF THE INVENTION

A nip roller apparatus according to the present invention includes a drive roller, an idler roller, and a toothed wheel driving means for transmitting rotation of the drive roller to the idler roller. The driving means includes toothed wheels mounted on shafts of their respective rollers. A pressing means is provided for urging the idler roller along a pressing direction in order to press against the drive roller. The idler roller shaft is mounted so as to be movable in the pressing direction. In particular, the nip roller apparatus of the present invention is characterized in that the pressing direction of the idler roller is tilted or shifted in a rotating direction of the idler roller from a radial center line which includes a contact point between the two toothed wheels, so that the pressing direction extends at an angle which is equal to the pressure angle of the toothed wheels.

As the pressing direction of the idler roller is moved from the radial center line, which runs across the contact point between the two toothed wheels in the rotating direction of the idler roller by the pressure angle of the toothed wheel, a counter stress acting on the idler roller against the pressing force will hardly be generated.

More specifically, the pressure angle of the toothed wheel is defined between the radial center line of the toothed wheels and the tangent line at the contact point (namely, a pitch point) on the surface of the toothed wheel.

When the pressing direction of the idler roller is tilted or shifted by the pressure angle, it extends at a right angle to a counter stress exerted on the toothed wheel of the drive roller by a resistance load acting on the idler roller. Accordingly, even if a counter force of the stress is applied to the toothed wheel of the idler roller, there is hardly any force produced which will act on the idler roller in opposition to the pressing force, assuming that the entire counter force on the toothed wheel is transmitted to the shaft since the toothed wheels and the nip rollers are assembled in a single rigid unit. Therefore, a difference of nip pressure at opposite sides of the nip roller apparatus will be eliminated.

DETAILED DESCRIPTION OF THE PREFERRED EMBODIMENT

Figure 2:
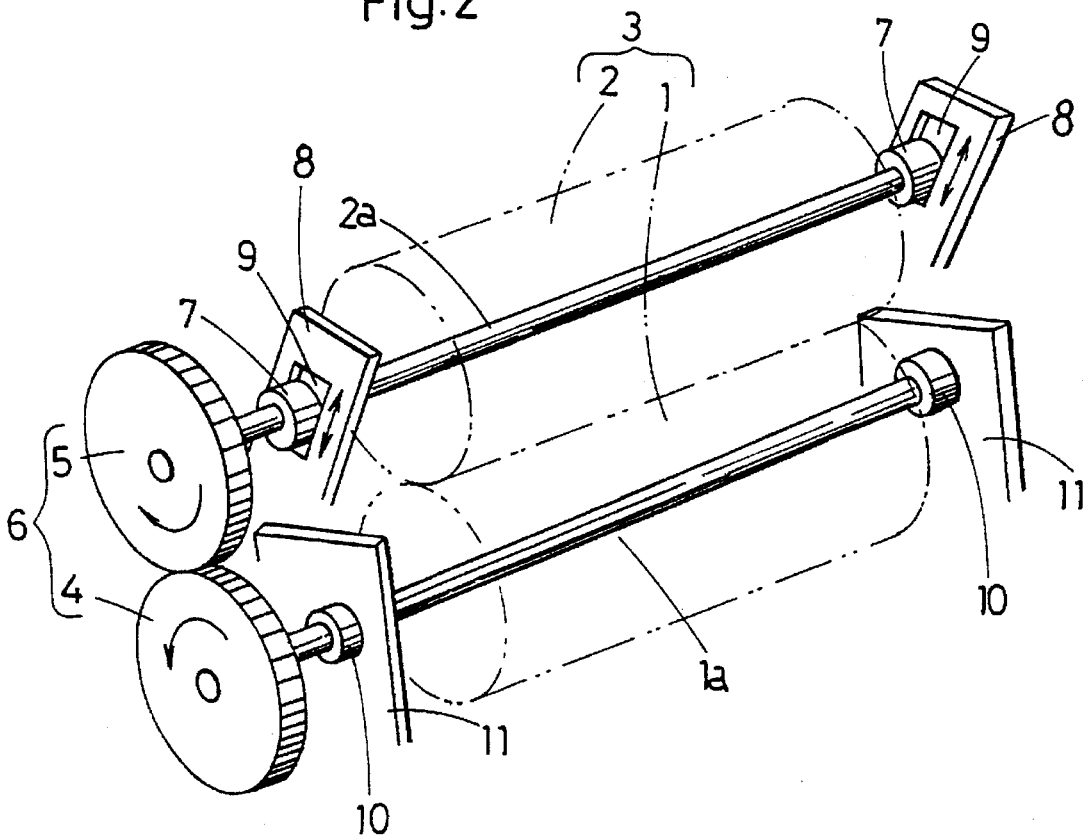
FIG. 2 is a perspective view of the embodiment illustrated in FIG. 1.

A nip roller apparatus according to the present invention includes a nip roller assembly 3 and a toothed wheel driving means 6, as shown in FIG. 2.

The nip roller assembly 3 includes a drive roller 1 and an idler roller 2 which presses against the drive roller 1.

The toothed wheel driving means 6 includes a toothed drive wheel 4 and a toothed idler wheel 5 mounted on shafts 1*a* and 2*a* of rollers 1 and 2, respectively, so that the rotation of the drive roller 1 is transmitted to the idler roller 2. The toothed drive wheel 4 is driven by an electric motor (not shown). In this embodiment, the two toothed wheels 4 and 5 are involute gears.

The shaft 1*a* of the drive roller 1 is supported at opposite ends by two bearings 10 which are fixedly mounted to a bearing support 11.

The shaft 2*a* of the idler roller 2 is supported at opposite ends by two bearings 7 which are mounted for sliding movement in and along guide slots 9, respectively. The guide slots 9 are provided in a bearing support 8.

Figure 1:
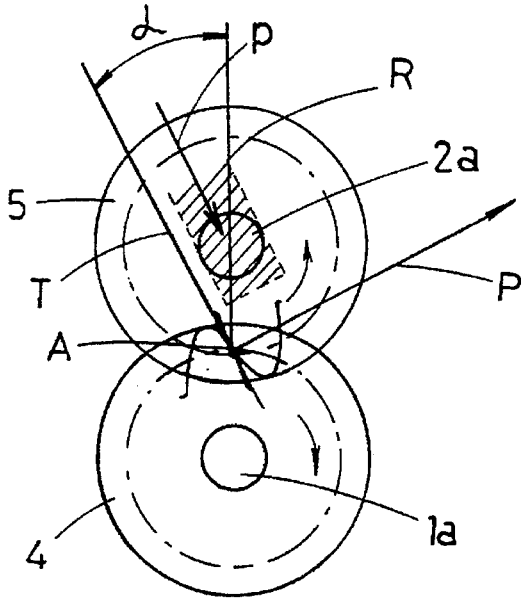
FIG. 1 is a side view of a nip roller apparatus showing an embodiment of the present invention.

The idler roller 2 is resiliently urged in a pressing direction p by a spring material (not shown), as shown in FIG. 1.

Each of the guide slots 9 in the bearing support 8 is tilted in the rotating direction of the toothed wheel 5 (denoted by the arrow) so that the lengthwise centerlines of the guide slots 9 extend (in the pressing direction of the idler roller 2) at an angle equal to the pressure angle α of the toothed wheel 4 with respect to the radial line R of the toothed wheels 4 and 5 which includes a contact point A between the toothed wheels 4 and 5.

The above arrangement allows the pressing or moving direction p of the idler roller 2 in and along the guide slot 9 to be at the pressure angle α and extend in parallel with a tangent line T of the contact surface which extends through the contact point A between the toothed wheels 4 and 5 (FIG. 1).

Since the pressing direction p of the idler roller 2 is at a right angle to a counter force P, which occurs in response to the stress exerted by a resisting load on the toothed idler wheel 5, the pressing force is free from any counter action or opposition force.

The pressure angle α of the toothed wheel 4 is preferably 20 or 14.5 degrees and the pressing direction p of the idler roller 2 is arranged at the same angle.

In a case where the pressure angle α is varied due to an error in the accuracy of meshing and shape of the toothed wheels, the pressing direction p of the idler roller 2 may not be perpendicular to the counter force P. However, such a variation of the pressure angle is negligible because the resultant lifting action on the idler roller 2 is substantially smaller than, and offset by, the friction between the bearings 7 of the shaft 2*a* of the idler roller 2 and the bearing support 8 in the guide slots 9.

Figure 3:
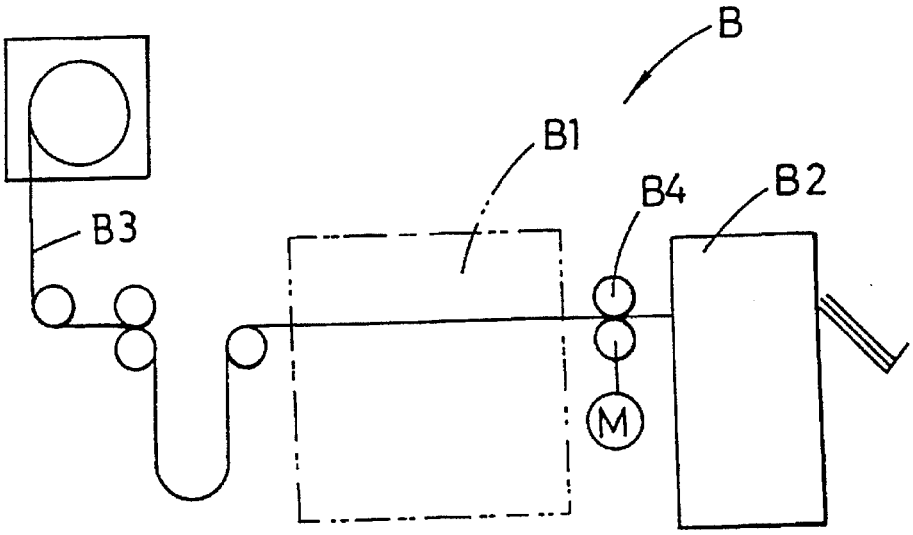
FIG. 3 is a schematic view of a photographic printing and development apparatus using the nip roller apparatus illustrated in FIG. 1.
Figure 4:
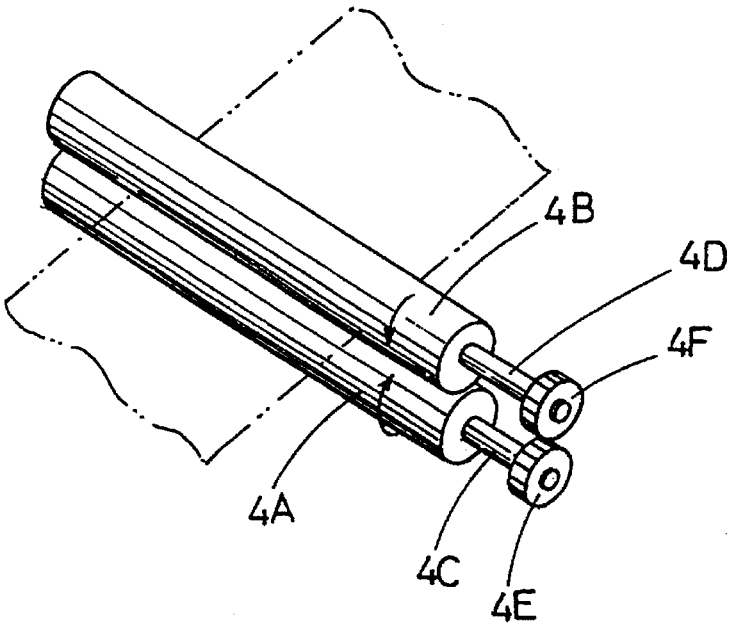
PRIOR ART Fig.4
FIG. 4 is a schematic view of a conventional nip roller apparatus.
Figure 5:
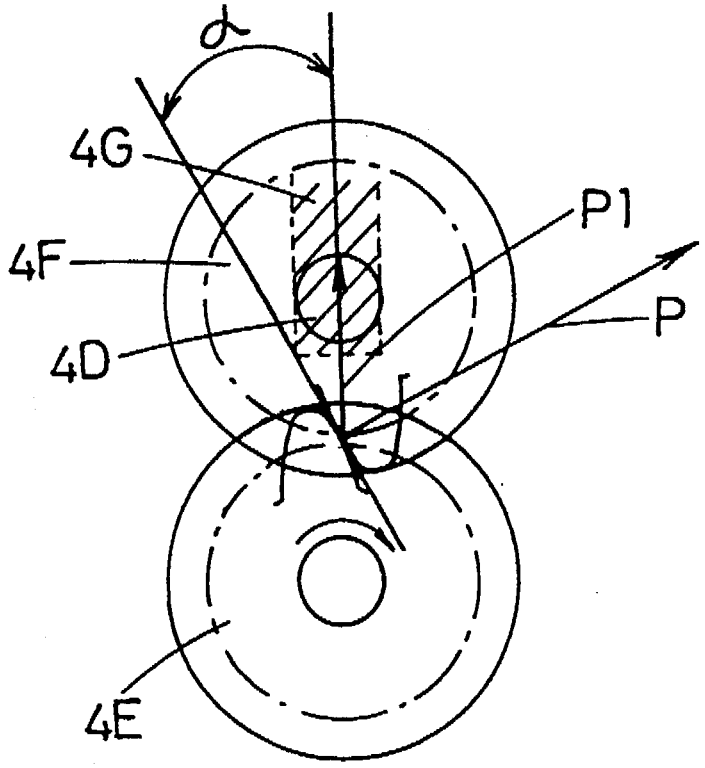
PRIOR ART Fig. 5
FIG. 5 is a side view of the conventional nip roller apparatus illustrated in FIG. 4.

The nip roller apparatus of the present invention is desirably applicable as a transfer roller unit B4 for conveying a photosensitive material B3 in a photographic automatic printing and developing apparatus B which includes an exposure station B1 and a development station B2 as shown in FIG. 3. However, the nip roller apparatus of the present invention is not limited to the above described application.

What is claimed is:

1. A nip roller apparatus comprising:

a rotatable drive roller mounted on a drive shaft having a toothed drive wheel having contact surfaces arranged at a pressure angle;

an idler roller mounted on an idler shaft having a toothed idler wheel having contact surfaces which are arranged at said pressure angle and are engagable with said contact surfaces of said toothed drive wheel such that rotary motion of said drive roller is transmitted to said idler roller; and pressing means for urging said idler roller against said drive roller in a pressing direction inclined in a rotation direction of said idler roller so as to extend at a pressing angle relative to a radial line passing through said shafts and a contact point between said contact surfaces of said drive wheel and said idler wheel, said pressing angle being equal to said pressure angle of said contact surface of said toothed drive wheel at said contact point.

2. The nip roller apparatus as claimed in claim 1, further comprising an idler shaft support including guide slots receiving opposite ends of said idler shaft.

3. The nip roller apparatus as claimed in claim 2, wherein each of said guide slots has a longitudinal centerline which extends at an angle relative to said radial line passing though said shafts and said contact point, said angle of said longitudinal centerline being equal to said pressure angle of said toothed drive wheel at said contact point.

4. The nip roller apparatus as claimed in claim 1, wherein said pressure angle is 20 degrees.

5. The nip roller apparatus as claimed in claim 1, wherein said pressure angle is 14.5 degrees.

* * * * *